US009540806B2

(12) United States Patent
Lasselsberger

(10) Patent No.: US 9,540,806 B2
(45) Date of Patent: Jan. 10, 2017

(54) FACING ELEMENT FOR A BUILDING

(71) Applicant: LB ENGINEERING GMBH, Poechlarn (AT)

(72) Inventor: Josef Lasselsberger, Erlauf (AT)

(73) Assignee: LB Engineering GmbH, Poechlarn (AT)

( * ) Notice: Subject to any disclaimer, the term of this patent is extended or adjusted under 35 U.S.C. 154(b) by 0 days.

(21) Appl. No.: 14/443,156

(22) PCT Filed: Sep. 23, 2013

(86) PCT No.: PCT/AT2013/050191

§ 371 (c)(1),
(2) Date: May 15, 2015

(87) PCT Pub. No.: WO2014/075118

PCT Pub. Date: May 22, 2014

(65) Prior Publication Data

US 2015/0308104 A1 Oct. 29, 2015

(30) Foreign Application Priority Data

Nov. 15, 2012 (AT) ..... A 50519/2012

(51) Int. Cl.
*E04B 1/76* (2006.01)

(52) U.S. Cl.
CPC ..... *E04B 1/7645* (2013.01); *E04B 1/762* (2013.01)

(58) Field of Classification Search
CPC ..... E04B 1/7645; E04B 1/70; E04B 1/7069; B32B 3/30; B32B 3/26
(Continued)

(56) References Cited

U.S. PATENT DOCUMENTS 3,888,087 A * 6/1975 Bergsland ..... E04B 1/7023 405/36
4,572,700 A * 2/1986 Mantarro ..... E01C 11/225 210/486

(Continued)

FOREIGN PATENT DOCUMENTS

AT 008180 U1 3/2006
AU 2006203389 A1 2/2007

(Continued)

OTHER PUBLICATIONS

International Search Report of PCT/AT2013/050191 dated Jan. 10, 2014.

(Continued)

*Primary Examiner* — Joshua J Michener
*Assistant Examiner* — Alp Akbasli
(74) *Attorney, Agent, or Firm* — Sutherland Asbill & Brennan LLP

(57) ABSTRACT

The invention relates to a facing element, particularly a plate-shaped facing element (1), for a wall of a building, with an inner boundary surface (2) on the side facing towards the wall and an outer boundary surface (3) on the side facing away from the wall. According to the invention, at least one cavity (6) is arranged between the inner boundary surface (2) and outer boundary surface (3), which cavity (6) extends from a lower boundary surface (4) of the facing element (1) to an upper boundary surface (5) of the facing element (1), and wherein at least one punch hole (7, 7') is provided, which extends from the wall-side boundary surface (2) as far as the at least one cavity (6).

21 Claims, 5 Drawing Sheets

Figure 1:
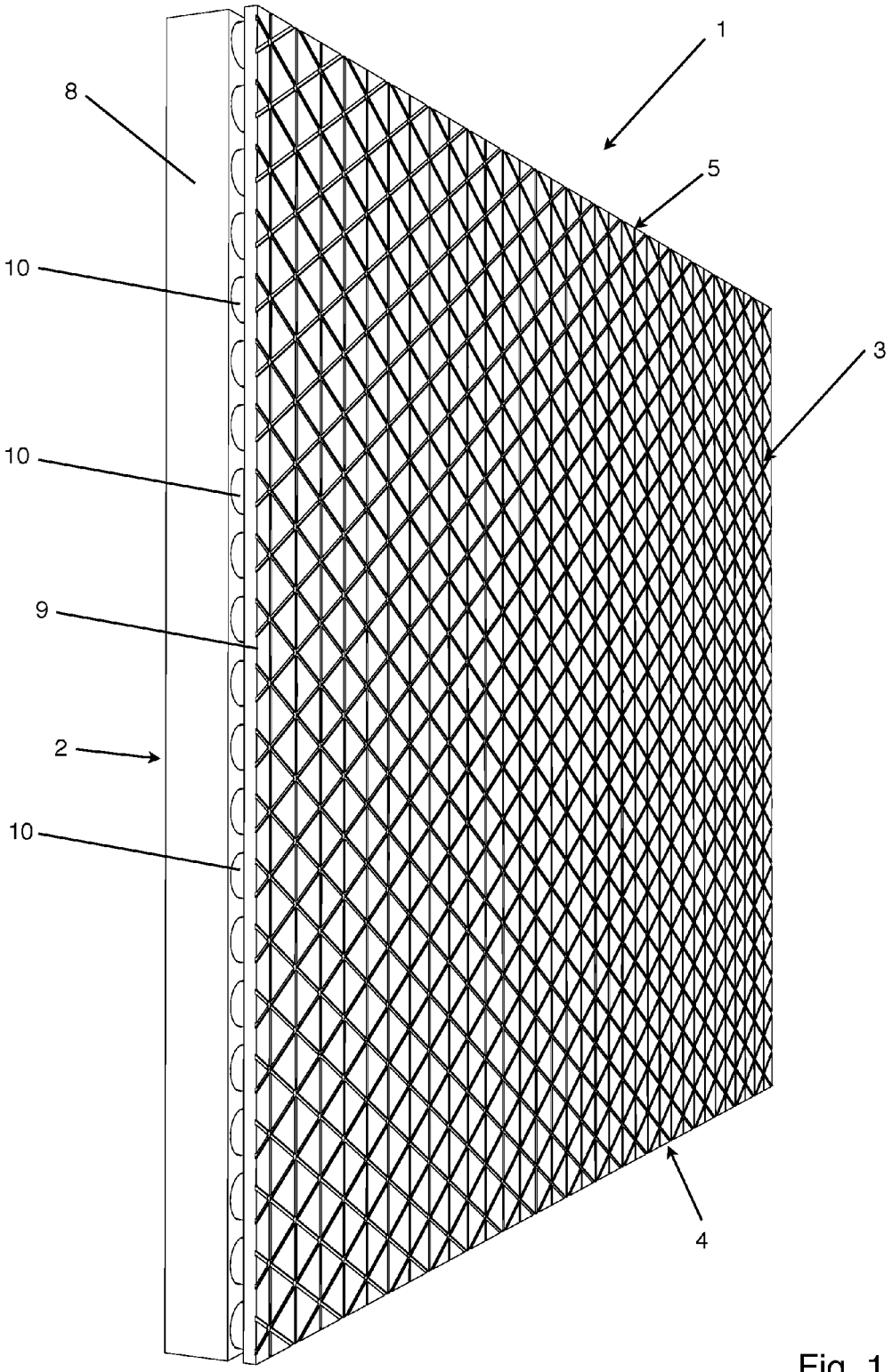

(58) Field of Classification Search
USPC ..... 52/302.1, 302.3
See application file for complete search history.

(56) References Cited

U.S. PATENT DOCUMENTS

| | | | | |
|---|---|---|---|---|
| 4,840,515 | A * | 6/1989 | Freese | E02B 11/005 405/36 |
| 6,017,597 | A * | 1/2000 | Minakami et al. | 428/34.4 |
| 6,023,892 | A * | 2/2000 | Sourlis | E04B 1/644 210/170.01 |
| 6,298,620 | B1 * | 10/2001 | Hatzinikolas | 52/302.1 |
| 6,684,579 | B2 * | 2/2004 | Brunson | E04B 1/7061 52/169.14 |
| 6,990,775 | B2 * | 1/2006 | Koester | 52/302.1 |
| 7,730,685 | B1 * | 6/2010 | Keene | E04B 1/7046 52/169.5 |
| 8,291,668 | B2 * | 10/2012 | Iske | E21D 11/381 52/414 |
| 8,555,581 | B2 * | 10/2013 | Amend | 52/302.1 |
| 8,769,894 | B2 * | 7/2014 | Power et al. | 52/302.3 |
| 2001/0054263 | A1 | 12/2001 | Coulton | |
| 2002/0108333 | A1 * | 8/2002 | Clayton | 52/302.1 |
| 2005/0055983 | A1 * | 3/2005 | Tomes | 52/782.1 |
| 2010/0287865 | A1 * | 11/2010 | Hatzinikolas | 52/302.1 |
| 2012/0285116 | A1 * | 11/2012 | Walker | 52/741.4 |
| 2012/0324814 | A1 * | 12/2012 | Amend | 52/302.1 |
| 2013/0114142 | A1 * | 5/2013 | Free et al. | 359/530 |
| 2013/0125487 | A1 * | 5/2013 | Power et al. | 52/302.3 |

FOREIGN PATENT DOCUMENTS

| | | | |
|---|---|---|---|
| DE | 2931223 | A1 | 2/1981 |
| DE | 3103474 | A1 | 8/1982 |
| DE | 4433161 | A1 | 3/1996 |
| DE | 102007040938 | A1 | 12/2008 |
| DE | 202010014348 | U1 | 2/2011 |
| EP | 1431472 | A1 | 6/2004 |
| GB | 822954 | A | 11/1959 |
| WO | 2011016961 | A2 | 2/2011 |

OTHER PUBLICATIONS

First Office Action of Austrian priority patent application No. 50519/2012 dated Jun. 5, 2013.

* cited by examiner

FACING ELEMENT FOR A BUILDING

The invention relates to a facing element, particularly a plate-shaped facing element for a building or for a wall of a building, with an inner boundary surface on the side facing towards the wall and an outer boundary surface on the side facing away from the wall.

The invention furthermore relates to a wall cladding consisting of a number of such facing elements.

Currently, houses are generally provided with thermal insulation. For this purpose, the wall of a building is cladded with facing elements on its outside, for example with polystyrene insulation boards. This insulation reduces the heat loss through the outer wall of the building.

The facing elements are pargeted on their outside (i.e., a filler compound is applied on the facing elements, subsequently reinforcing, an additional filling, primer, and finally the plaster coat) and therefore also provide weather protection for the building.

A further requirement to be met by such facing elements or insulation boards is that they must be suitable to permit a sufficient amount of water vapor to diffuse outward from inside of the building, to ensure that none or only very little condensation can develop. The excessive formation of condensation water can result in damaging the wall structure as well as mold formation in the interior.

An object of the invention is to provide a facing element which in addition to the necessary strength additionally offers good back ventilation of the building frontage. At the same time, the insulating properties of the facing element must be maintained.

This object is achieved with a facing element mentioned at the outset, in that according to the invention, at least one cavity is arranged between the inner boundary surface and the outer boundary surface, which cavity extends from a lower boundary surface of the facing element to an upper boundary surface of the facing element, and wherein furthermore at least one perforation is provided, which extends from the boundary surface facing the wall as far as into the at least one cavity.

Using a facing element according to the invention, a back-ventilated frontage can be realized, in which water vapor in the cavities of superposed facing elements which gets into the cavities through the perforations in the facing elements of the building, and where such water vapor rises to the top and escapes from the very top facing elements in the very top area of the building can thus be discharged from the building easily and securely.

In addition, decoupling of the wall-side area from the outer area occurs, so that high or low temperatures temperature fluctuations will not be discharged to the side of the facing element facing the wall, or only with a delay.

To facilitate optimal discharge of the water vapor and ensure a sufficient mechanical stability of the facing element at the same time, one variant of the invention provides that two or preferably multiple cavities, which extend from the lower up to the upper boundary surface are provided between the inner and the outer boundary surface.

To discharge the water vapor evenly from the building, it is an advantage if the cavities are distributed uniformly across the width of the facing element.

In terms of production technology it is easier, if the at least one cavity in a facing element that is affixed to a building wall is developed essentially running straight and preferably essentially running vertical.

A linear embodiment permits to configure the cavities in the form of channels as short as possible and without bends, so that the water vapor can be discharged quickly. The channels are preferably configured vertical, wherein, depending upon the embodiment, it can however also be possible that these have a certain trend to the vertical.

It is particularly advantageous, if two or more, preferably a plurality of perforations, are provided.

It is furthermore advantageous if the perforations are distributed evenly across the width and/or height of the facing element.

In this manner, the water vapor can be discharged uniformly across the entire surface of the facing element.

Preferably it is provided that the perforations are facing the inner boundary surface facing the wall.

This will result in short perforations, so that water vapor can get quickly into the one or the more cavities, and additionally it can be easily produced in terms of production technology.

In a specific embodiment of the invention it is provided particularly advantageously that the facing element has a two-part structure and is formed from an inner part facing towards the building and an outer part facing away from the building, wherein the inner part and the outer part are spaced apart from one another by means of spacers.

If the inner part and the outer part are connected, the one or the multiple cavities between the two parts are formed on the inside of the facing element by the spacers.

In terms of production technology, such facing element can be produced easier than when producing from only one part in the inside of which cavities must be arranged.

The earlier addressed decoupling of the inner and outer area of the facing elements contributes especially well as a support in such two-part structure of the facing element. The inner part will moreover be either not or be less subjected to loads or even other influences, for example atmospheric influences, so that the insulating properties of the inner part will not be reduced by such load.

In this embodiment it is provided that the perforations are arranged on the inner part and penetrate the inner part from the boundary surface facing the building up to its outer part facing the exterior surface.

As already mentioned above, the spacers are arranged such that the one or the multiple cavities are developed as essentially vertical channels between the inner part and the outer part which extend from the bottom to the top.

In a particularly preferred embodiment it is provided that the spacers, in the state where the facing element is not assembled, are connected with the inner part or preferably with the outer part, and are preferably produced as one piece with the inner part or the outer part.

The spacers, the inner part and the outer part can in principle be designed as separate structural components. In order to limit the number of structural components and to simplify the assembly, it is an advantage, however, if the spacers are designed to be connected with the inner part or the outer part, preferably as one piece.

Spacers could also be arranged on both parts, in principle, however in the fabrication and in the assembly it is easier if the spacers (in the unassembled state of the facing element) are arranged only on one structural component.

Preferably, these are mounted as a one-piece configuration on the outer part, since the outer part, as further explained below, preferably has a higher strength then the inner part and thus the spacers also have a higher strength.

In one version of the invention, the spacers are developed as continuous webs extending from the upper boundary surface to the lower boundary surface.

In this manner, continuous channels are formed which are separate from one another and extend from the top to the bottom.

In another preferred embodiment of the invention, the spacers are developed in the form of tabs projecting from the inner part or preferably from the outer part, for example cylindrical or in the form of a truncated cylinder, such as a circular cylinder frustum.

These tabs or protuberances can essentially have any desired form, for example a circular cross-section, an angular, e.g. rectangular cross-section, wherein a circular cylinder frustum with a circular base area is provided in a specific embodiment.

Furthermore it is advantageously provided that the spacers are essentially uniformly distributed in the form of tabs across an exterior surface of the inner part or across an inner surface of the outer part.

When using such "discrete" spacers in the form of tabs or protuberances, the facing element comprises no self-contained channels in its inside, but the (essentially) vertical channels are connected to one another by means of diagonal channels. The smaller the cross-sectional surfaces of the individual spacers are compared to the surface of the exterior surface of the inner part or to the inner surface of the outer part (the surfaces of which are identical to the boundary surfaces of the facing element), the more the structure of multiple individual channels disintegrates, and then only a single cavity exists between the two structural components, which extends from the bottom toward the top. This cavity is interspersed with the spacers.

Furthermore it is advantageously provided that a structure in the form of one or multiple recesses is provided on the boundary surface facing away from the wall and/or on the boundary surface facing toward the wall.

These recesses are in the form of longitudinal indentations, for example, which intersect in a honeycombed configuration, are provided on the outside and/or on the inside of the facing element and produce a better adhesion of the fill and therefore the exterior finish (on the outside) as well as a better adhesion of the adhesive composition (adhesive mortar) on the inside with which the facing element is attached onto a building.

It can furthermore be provided that mounting hole patterns are provided on the outer part, which extend from the boundary surface facing away from the wall through the spacers, in particular passing through the tabs.

The inner part and the outer part can be connected by means of these mounting hole patterns, for example in that adhesive is introduced from outside through the mounting hole patterns with which the protuberances of the outer part are then bonded to the inner part.

The mounting hole patterns can alternatively or preferably in addition still be provided so that they facilitate easier positioning of the facing element on the wall of a building. In certain cases, such as during the refurbishing of old buildings, it is frequently mandatory that the facing elements in addition to the bonding also attached to the wall with dowels. The mounting hole patterns then indicate to the user, where the facing element can be attached onto the wall with dowels, to ensure that the dowel will penetrate the facing element in the area of the protuberances and not in the cavity of the facing element.

The mounting hole patterns can already be developed during the fabrication of the facing element, or they can be installed subsequently in the form of drill holes.

An alternative possibility for connecting the outer part and inner part of the facing element is to apply the adhesive directly in the contact area between the protuberances and the inner part. In this case, the mounting hole patterns for introducing the adhesive are not necessary, but they continue to be advantageous for securing the facing element onto the wall of a building as described above.

It is particularly advantageous, if the inner part and the outer part have a different strength, wherein the outer part will preferably have a higher strength than the inner part.

An increased strength of the outer part, i.e. a higher density of the material used for the outer part has the advantage that the outer part can better counteract static and mechanical stresses. The inner part can have been produced from a material of lower density, because it is subjected to lesser static and mechanical loads, as a result of which the facing element can be designed to be lighter than if the density were equally high throughout.

The facing element is preferably made of an expanded plastic, such as polystyrene, preferably produced from expanded polystyrene.

In this context it can be provided that both parts are formed from polystyrene, wherein the outer part can be formed from a higher density polystyrene, for example.

It can also be provided that the outer part is produced from polyurethane foam, for example, which is fireproof, so that the facing element is fireproof while the inner part can be formed of polystyrene.

The facing element is preferably used as an insulating element for a wall of a building.

The facing element according to the invention typically comprises perforations, all of which have the identical diameter. These perforations are typically not filled with any material.

It can furthermore also still be provided, however, that perforations with a different diameter extending from the boundary surface facing towards the wall up to the at least one cavity, are provided.

If the facing element is insufficiently non-vapor retarded in spite of the perforations, the diameter of the perforations can essentially be enlarged, or a mixed structure of perforations with differently sized diameters can be provided.

In this context, an advantageous embodiment provides that exactly two different diameters for perforations are provided. Then, a number of perforations with a smaller diameter and a number of perforations with a larger, preferably significantly larger diameter, are provided.

In order that the insulating properties of the facing element or the inner part of the facing element are not impaired, it is provided that at least some of the perforations are filled with an insulating material, preferably with mineral wool For this purpose it is preferably provided that at least those perforations having the smallest diameter will not be filled with insulating material.

Therefore, especially the perforations with a larger diameter are filled with an insulating material, while perforations with a smaller diameter are not filled.

If only perforations with a larger diameter are provided, then these are preferably filled with an insulating material.

A facing element according to the invention described above is preferably provided that is suitable for cladding the exterior of a building.

Figure 1A:
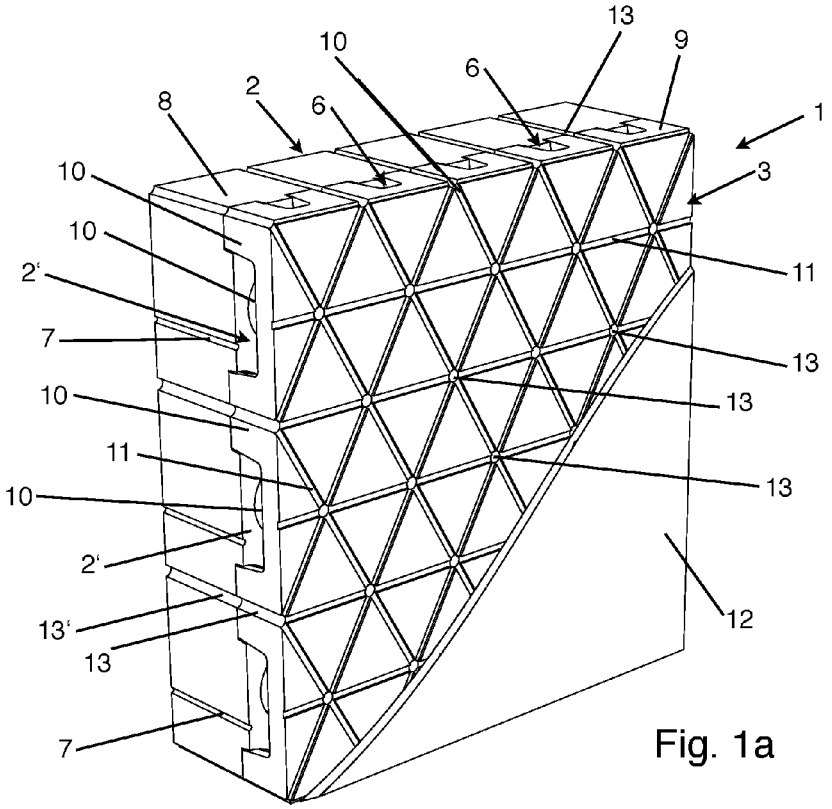
Figure 2:
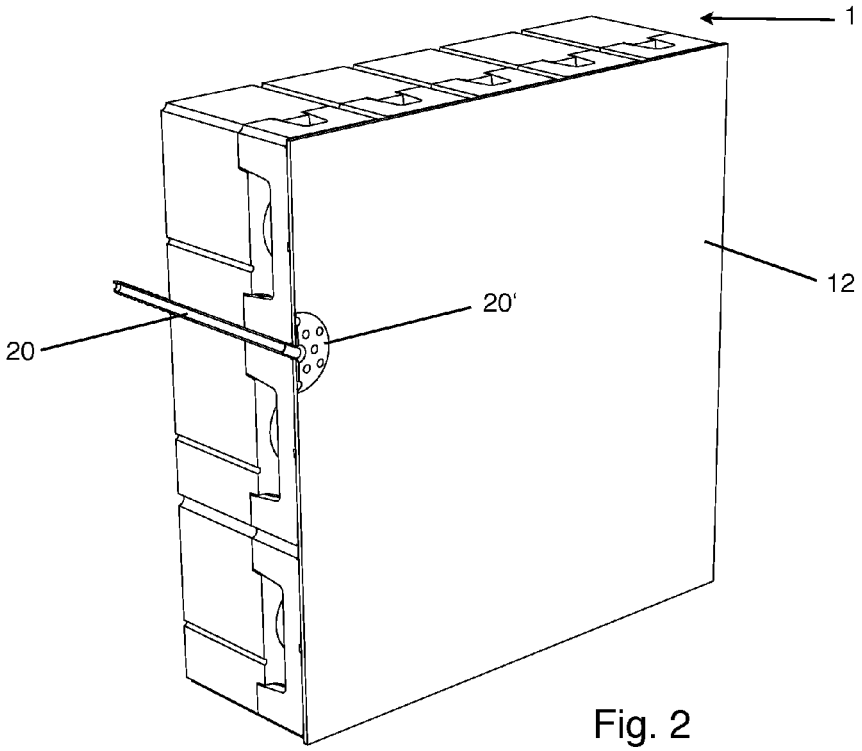
Figure 3:
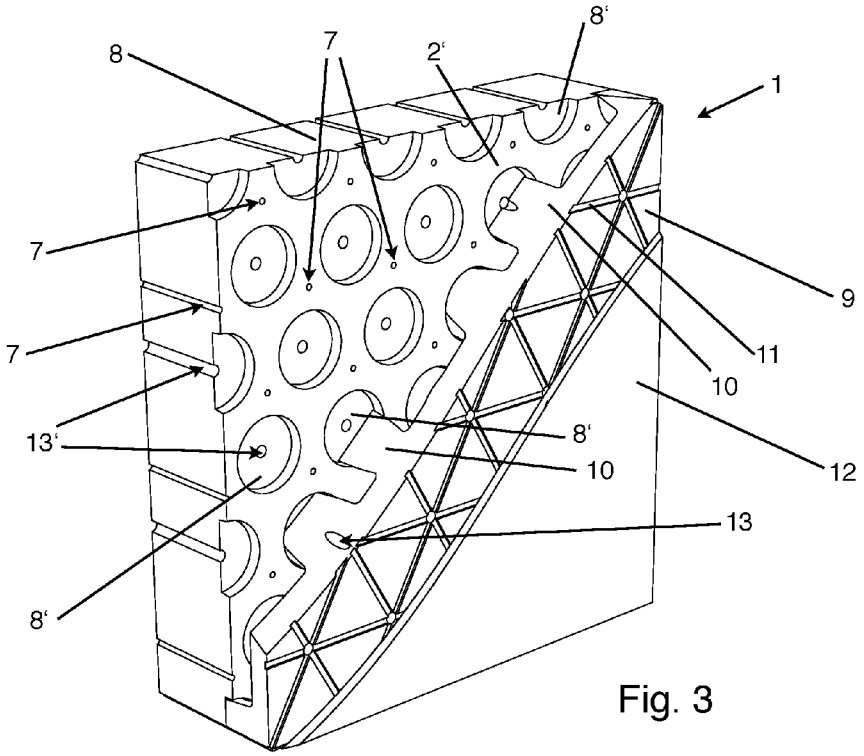
Figure 4:
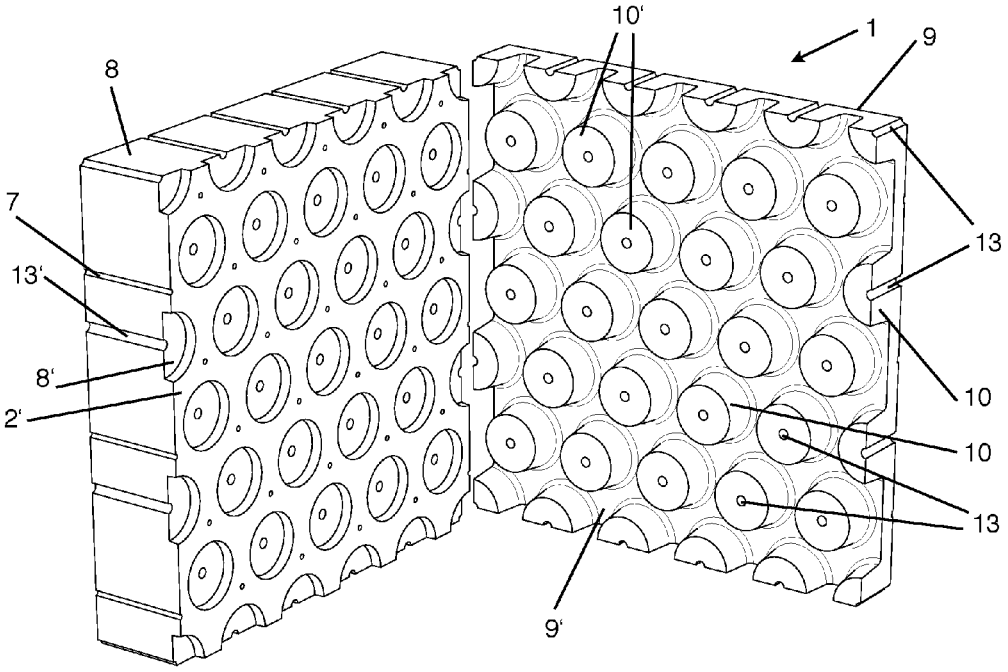
Figure 5:
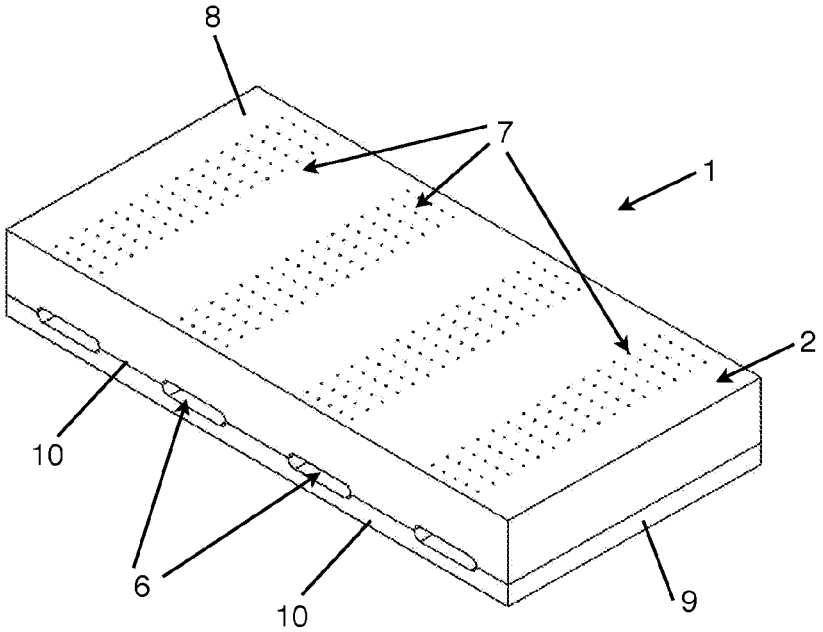
Figure 6:
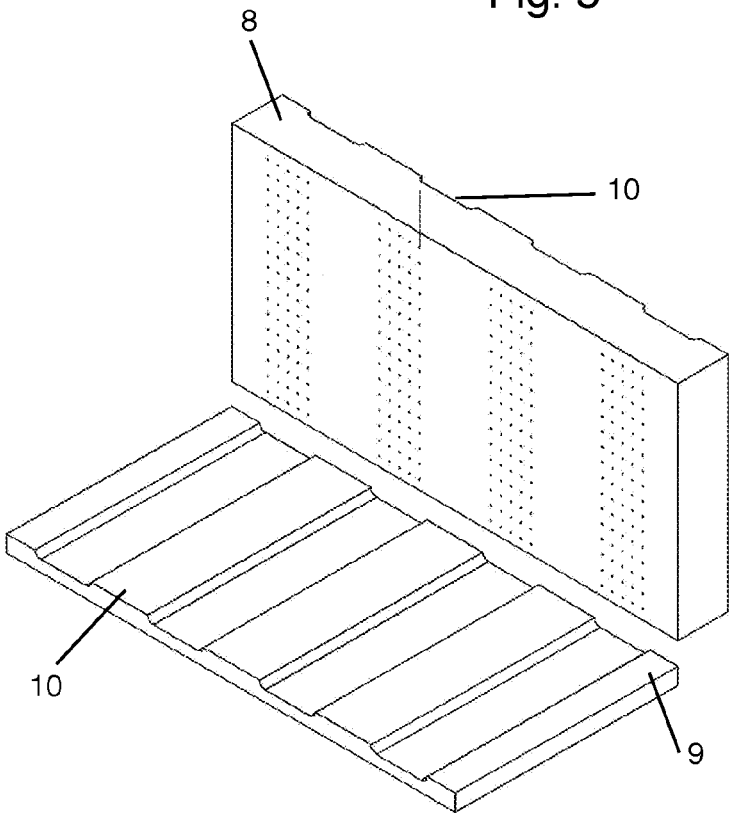
Figure 7:
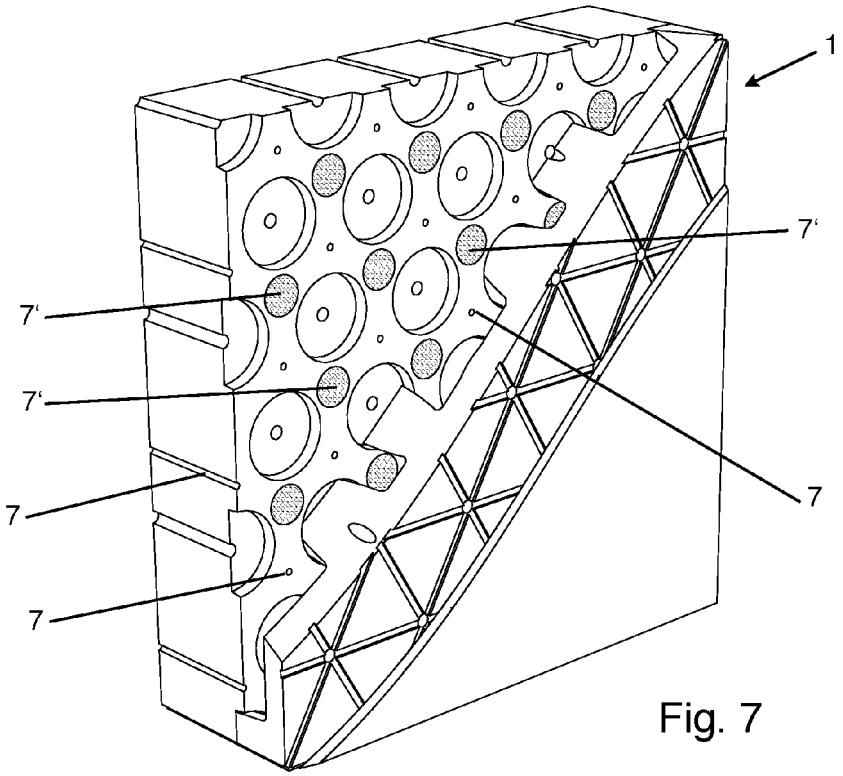
Figure 8:
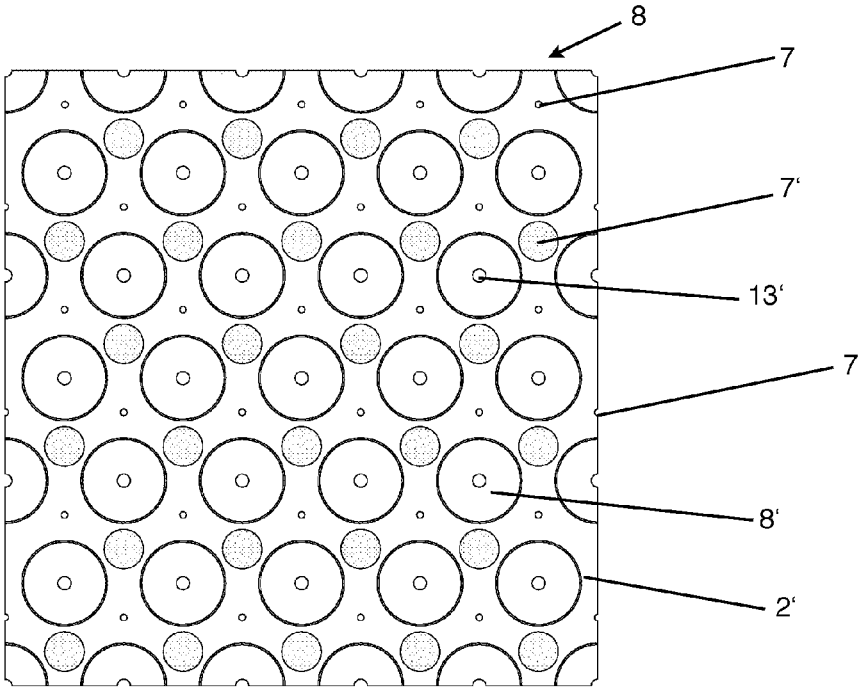

In the following, the invention is explained in greater detail by means of the drawing, which shows:

FIG. 1 is a perspective view of a facing element as taught by the invention, FIG. 1*a* is a perspective view of a section from a facing element as taught by the invention, FIG. 2 is the section of the facing element from FIG. 1, provided completely with a plaster coat, FIG. 3 is the section of the facing element from FIG. 2, in a partially cut [sic] through the outer part of the facing element and through the plaster coat, FIG. 4 is the section of a facing element from FIG. 1, provided completely with a plaster coat, in the unfolded state, FIG. 5 is a further variant of a facing element as taught by the invention, FIG. 6 is the facing element from FIG. 5 in the unfolded state, FIG. 7 is a perspective view of a section from a further facing element as taught by the invention, and FIG. 8 is a plan view of the inside of the inner part of a facing element according to FIG. 7.

FIG. 1 shows a facing element 1 according to the invention for cladding a wall of a building. The facing element 1 in this context serves preferably as insulating element for the wall or the building; an appropriate wall cladding or building cladding is created from facing elements that are arranged superposed and side-by-side, directly connected together.

The facing element 1 has a two-part structure and consists of an inner part (8) facing the building and an outer part 9 facing away from the building. The inner part 8 and the outer part 9 are spaced apart from one another by means of spacers 10 and are connected together, so that between the two parts 8, 9 and thus between the inner boundary surface 2 of the facing element 1 facing the wall (which in the assembled state of the facing element 1 is the exterior surface of the inner part 8) and an outer boundary surface 3 of the facing element 1 facing away from the wall (which in the assembled state of the facing element 1 is the exterior surface of the outer part 9) a cavity 6 is created.

As a result of the arrangement of the spacers 10, the cavity 6 extends in the mounting position of the facing element 1 (i.e. in that position, in which the facing element is attached to the building wall) from the lower boundary surface 4 of the facing element 1 up to the upper boundary surface 5 of the facing element 1.

FIG. 1*a* illustrates a section from a facing element 1 from FIG. 1. As illustrated in the FIGS. 1*a* and

2-4, the spacers 10 are developed in the form of tabs for example as shown, projecting from the outer part in the form of circular cylinder frustums, see particularly FIG. 3 and FIG. 4.

The spacers, in the following also referred to as protuberances 10, in this context are broadening towards the outer part in the illustrated representation, i.e. the cross-sectional surface of the protuberances 10 on the outer part 9 is greater than their contact surface 10' facing away from the outer part 9. Protuberances 10 which have a cylindrical design are easier to produce, however.

The contact surfaces 10' are preferably planar shaped and in the assembled condition run parallel to the exterior surface 2' of the inner part 8 facing the outer part 9.

These tabs or protuberances 10 are developed as one piece with the outer part 9 and project perpendicular from the inner surface 9' of the outer part 9. The protuberances 10 are preferably distributed evenly across the inner surface 9' and comprise identical shape and dimensions.

In the assembled state, the protuberances 10 with their contact surfaces 10' for example bear against the exterior surface 2' of the in the part 8 (not shown in the Figures). In this context, fastening the two parts 8, 9 to one another is preferably done by means of bonding.

In a preferred embodiment as shown in the Figures and as can particularly clearly recognized in FIG. 4, recesses 8' are provided on the exterior surface 2' of the inner part 8, into which the protuberances 10 of the outer part 9 are inserted during the assembly of the two parts 8, 9.

The protuberances 10 are bonded with the inner part 8 in the recesses 8'. Due to the recesses 8', a larger adhesive surface results than when bonding directly on the exterior surface 2' of the inner part 8 on the one hand, and on the other this embodiment prevents a guard against transversal shift between the outer part 9 and the inner part 8.

To connect the protuberances with the inner part 8, the adhesive can be applied directly onto the protuberance surface 10', and/or it is provided that the adhesive is introduced directly into the recesses 8', and the protuberances 10 are subsequently inserted into the recesses 8.

In another variant of the bonding it is provided that mounting hole patterns 13 are provided on the outer part 9, as illustrated in the Figures (see FIGS. 1, 4), which extend from the boundary surface 3 facing away from the wall through the spacers 10 and completely through the outer part 9. By means of these mounting hole patterns 13, the inner part 8 and the outer part 9 can be connected together, and the adhesive can be injected during the assembly of the inner part 8 and the outer part 9 completely through the mounting hole patterns 8' into the recesses, i.e. between the protuberances 10 and the inner part 8 into the recesses 8', preferably shortly before the protuberances 10 are moved into the recesses 8'. Once the adhesive is introduced or still while introducing the adhesive, the protuberances 10 are moved into their end position in which they are in line with the surfaces 10' at the bottom of the recesses 8'.

As regards the mounting hole patterns 13, this involves bores for example, which are drilled into the finished outer part 9, or the mounting hole patterns 13 already created during the manufacturing process of the outer part 9.

The protuberances 10, which as already described, are typically shaped like truncated circular cones and the circular cross-section of which reduce across their height (when proceeding along the height away from the outer part 9), and when viewed across the height comprise diameters that are matched to the diameter of the recesses 8', so that the protuberances 10 can be inserted into the recesses 8' sufficiently deep, so that the contact surface 10' of the protuberances 10 is in line with the bottom of the recesses 8'.

In a typical embodiment, the recesses 8' have a diameter of approximately 65 mm, the protuberances 10 have a diameter of approximately 60 mm on their contact surface 10'.

The diameter of the contact surface 10' for this purpose corresponds preferably to the diameter of a head 20' of a dowel 20; such dowel 20 is shown in FIG. 2. Typical dowels for securing facing elements such as insulation boards onto a building comprise a head diameter of 60 mm. Such dowels 20 are used for dowelling the facing elements 1 into the wall of a building, such as is advantageous, preferable, or is statutorily required, in certain cases. For that purpose, the dowel 20 penetrates the entire facing element 1 preferably extending through the mounting hole patterns 13. Preferably, the inner part has additional perforations 13' in the recesses 8' connecting to the mounting hole patterns 13 (which are not in contact with the cavity 6), through which the dowel 20 can be pushed up into the wall.

The perforations 13, 13' preferably have a diameter which corresponds to the actual dowel diameter (not to the dowel head diameter) or is somewhat larger, so that the dowel can be easily pushed through the facing element 1.

The diameter of the contact surface 10' corresponds furthermore approximately to the diameter of the head 20' of a dowel 20, in order to exert optimal transmission of the retaining force of the dowel 20 to the facing element 1.

The dowels 20 are pushed through the facing element 1 through the mounting bores 13 for that reason, since in this manner it is reliably prevented that the dowels 20 get through the cavity/ies, where the facing element structure is developed weaker.

By developing the spacers in the form of discrete protuberances 10, the entire space between the inner part 8 and the outer part 9 actually forms a large cavity 6, except for the space that is occupied by the protuberances, which extends from the lower boundary surface 4 up to the upper boundary surface 5 of the facing element. The cavity 6 furthermore extends also from a lateral boundary surface up to the other lateral boundary surface.

In this context, the FIGS. 1*a*, 2-4 in each case show merely sections of a facing element; in these sections, the protuberances extend up to the (incision) edge or above. However, the protuberances are to the actual edges (bottom edge 4, top edge 5, lateral edges, see FIG. 1) i.e., the outermost protuberances do not try to reach up to the edge of the facing element, to prevent that the connection between the cavities of two facing elements that are adjacent to each other is closed, if the facing elements are poorly installed. The protuberances typically have a distance to the edge of approximately 1 cm-2.5 cm (normal distance of the closest edge section to the edge of a protuberance).

As can furthermore be found in FIGS. 1*a*, 2-4, the facing element 1 has a number of perforations 7 on its inner part 8, which penetrate the inner part 8 starting on the boundary surface 2 to up to the exterior surface 2' facing the outer part 9 and correspondingly extend up into the cavity 6. Water vapor gets through these continuous perforations 7, which normally preferably reach to the boundary surface 2, from the building wall into the cavity 6, in which it can rise to the top. The water vapor gets from a facing element into the cavity 6 of the superincumbent facing element, until it ultimately emerges from the uppermost facing elements in the uppermost area of the building and is thus discharged from the building.

The perforations 7 are created either directly during the production of the inner part 8 and are applied subsequently in the form of bores.

A typical facing element has a width of approximately 100 cm, a height of approximately 50 cm, and a thickness of approximately 8 cm-30 cm. On a surface of approximately 100 cm×50 cm, less the surface occupied by the protuberances or the recesses 8, approximately 200-1500, for example approximately 1200 perforations 7 are arranged.

The diameters of the illustrated perforations 7 in a specific embodiment are approximately 2 mm-4 mm.

The perforations 7 are advantageously evenly distributed across the width and height of the facing element 1 and are arranged such that they will always terminate in the cavity 6. In this manner, the water vapor can be discharged uniformly across the entire surface of the facing element.

Areas of the inner part 8, which in the assembled state of the facing elements abut against the protuberances 10, in this context are preferably free of perforations, however.

Generally, it is applicable that those areas of the inner part on which the spacers are in contact are free of penetrations 7 which connect the area facing the wall with the cavity/ies.

It is particularly advantageous, if the inner part 8 and the outer part 9 have different strength, wherein the outer part 9 preferably has a higher strength than the inner part 8.

A higher strength of the outer part, i.e. a higher density of the material used for the outer part has the advantage that the outer part can better counteract static and mechanical stresses. The inner part can be produced from a material of lower density, because it is subjected to lesser static and mechanical loads, as a result of which the facing element can be designed to be lighter than if the density were equally high throughout. Consequently, a light, robust facing element can be created which offers back ventilation in an optimal manner.

The facing element is preferably made of an expanded plastic, such as polystyrene, preferably produced from expanded polystyrene.

In this context, both parts 8, 9 are produced from polystyrene, wherein the outer part 9 can preferably consists of a polystyrene with higher density.

Expanded polystyrene (EPS) has good thermal insulation properties, is inexpensive, does not decay, and is vermin resistant. EPS however is relatively impermeable to diffusion; typical data for the EPS diffusion coefficient are around 55-60 μm. Through the penetrations 7, the diffusion coefficient of the inner part 8 can be reduced to a value of less or equal to 15 μm, so that water vapor can defuse easily through the inner part 8 without noticeably affecting the characteristics of EPS described above.

Reverting once again to FIG. 1, it is furthermore advantageously provided that a structure in the form of one or multiple recesses 11 is provided on the boundary surface 3 facing away from the wall.

These recesses are in the form of longitudinal indentations, for example, which intersect somewhat in honeycombed configuration, are provided on the outside 3 of the facing element 1, and produce a better adhesion of a fill onto which the exterior finish 12 is ultimately applied as described at the outset.

With this plaster coat it is of minor importance whether this is non-vapor retarded or not, since the water vapor is primarily discharged by means of the cavity/ies in the facing elements and not by means of the outer boundary surface 3 of the facing element 1.

Indentations as described above are preferably also still provided on the surface 2 of the facing element facing the wall (not illustrated), so that the adhesive or adhesive mortar for securing the facing element 1 onto a wall adheres better.

A further variant of the invention is represented in the FIGS. 5 and 6. This differentiates from the aforementioned embodiment discussed merely in that a large cavity 6 is not provided, but that the spacers 10 are developed as continuous, preferably straight webs 10 extending from the upper boundary surface 5 up to the lower boundary surface 4. In this manner, continuous vertical channels 6 are formed which are separated by the spacers 10 from one another and extend from the top to the bottom. A horizontal connection of the channels in the form of breakthroughs (not shown) is also possible and then results again in the embodiment as already described above. In this context the channels can essentially be developed running slightly sloping, but they should extend from the lower to the upper boundary surface. Through bores 7 extend again on the inner part 8 from the surface 2 up into the cavities 6. Through bores 7 are provided only in the areas between the spacers 10; areas with spacers are free of through bores 7.

FIG. 7 and FIG. 8 finally still show a section from a facing element, which essentially corresponds to that facing element as is shown in the FIGS. 1*a*, 2-4.

The facing element shown in FIGS. 1*a*, 2-4 has a number of perforations 7 with a smaller diameter of approximately 2 mm-4 mm. These perforations are empty, thus are not filled with any (insulating) material.

Supplementary to in the facing element according to FIGS. 7 and 8 on the inner part, still additional perforations 7' with a larger diameter are provided on the boundary surface 2 facing the wall that extend at least until into the at least one cavity 6.

A typical diameter for these larger perforations 7' is approximately 30 mm.

So that the insulating properties of the facing element or the inner part of the facing element are not impaired, it is provided that the perforations 7' are filled with an insulating material, preferably with mineral wool.

In a further not represented variant, only larger perforations are provided that are filled with insulating material, such as mineral wool.

The invention claimed is:

1. An insulation board (1) for a wall of a building, comprising:

an inner boundary surface (2) facing towards the wall and the building and an outer boundary surface (3) facing away from the wall and the building;

a cavity (6) formed between the inner boundary surface (2) and the outer boundary surface (3);

wherein the cavity (6) extends from a lower boundary surface (4) of the insulation board (1) up to an upper boundary surface (5) of the insulation board (1);

at least one perforation (7, 7') extending from the inner boundary surface (2) facing the wall to the cavity (6); and an inner part (8) facing the building and an outer part (9) of the insulation board (1) are spaced apart from one another by spacers (10) to form the cavity (6), wherein the spacers are discrete protuberances (10), wherein the discrete protuberances (10) that are closest to the edges of the insulation board are the outermost protuberances and are located a distance to the edges of the insulation board (1) and wherein the at least one perforation (7, 7') extends through the inner part (8) from the inner boundary surface (2) facing and adjacent to the wall to an exterior surface (2') of the inner part (8) facing away from the wall and into the cavity (6).

2. The insulation board according to claim 1, wherein the at least one perforation (7, 7') comprises two or more perforations (7, 7').

3. The insulation board according to claim 2, wherein the perforations (7, 7') are distributed evenly across a width and/or a height of the insulation board (1).

4. The insulation board according to claim 2, wherein the perforations (7, 7') are in the inner boundary surface (2) facing the wall.

5. The insulation board according to claim 1, wherein the insulation board (1) comprises a two-part structure and consists of the inner part (8) facing the building and the outer part (9) facing away from the building, and wherein the inner part (8) and the outer part (9) are spaced apart to one another by the spacers (10).

6. The insulation board according to claim 1, wherein the spacers (10), in a state where the insulation board (1) is not assembled, are connected with the inner part (8) or with the outer part (9) and are produced as one piece with the inner part (8) or outer part (9).

7. The insulation board according to claim 1, wherein the spacers (10) are projecting from the inner part (8) or the outer part (9).

8. The insulation board according to claim 7, wherein the spacers (10) are distributed uniformly in the form of tabs across an exterior surface (2') of the inner part (8) or across an inner surface (9') of the outer part (9).

9. The insulation board according to claim 1, further comprising one or more recesses (11) on the outer boundary surface (3) facing away from the wall, or on the inner boundary surface (2) facing toward the wall, or a combination thereof.

10. The insulation board according to claim 1, further comprising mounting hole patterns (13) on the outer part (9), which extend from the outer boundary surface (3) facing away from the wall through the spacers.

11. The insulation board according to claim 1, wherein the inner part (8) and the outer part (9) have different strength.

12. The insulation board according to claim 1, wherein the insulation board (1) is made of expanded polystyrene or another expanded plastic.

13. The insulation board according to claim 2, wherein perforations (7, 7') with a different diameter extend from the inner boundary surface (2) facing towards the wall up into the cavity (6).

14. The insulation board according to claim 12, wherein exactly two different diameters for perforations (7, 7') are provided.

15. The insulation board according to claim 2, wherein at least some of the perforations (7') are filled with an insulating material.

16. The insulation board according to claim 12, wherein at least those perforations (7) which have the smallest diameter have no insulating material filling.

17. A wall cladding for an exterior wall of a building, consisting of a number of insulation boards (1) according to claim 1.

18. The insulation board according to claim 7, wherein the spacers (10) comprise one or more cylindrical tabs, a truncated cylinder tab, or a cylinder frustum tab.

19. The insulation board according to claim 11, wherein the outer part (9) has a higher strength than the inner part (8).

20. The insulation board according to claim 15, wherein the insulating material comprises mineral wool.

21. The insulation board according to claim 1, wherein the protuberances (10) are at least partially positioned within a recess (8') in the inner part (8) or the outer part (9).

* * * * *